US007485991B2

(12) United States Patent
Kim et al.

(10) Patent No.: US 7,485,991 B2
(45) Date of Patent: Feb. 3, 2009

(54) VENTILATION APPARATUS

(75) Inventors: Sung Ki Kim, Yongin-si (KR); Seo-young Kim, Seoul (KR); Seung-jong Kim, Seoul (KR); Won-oyun Kim, Gwacheon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 515 days.

(21) Appl. No.: 11/283,813

(22) Filed: Nov. 22, 2005

(65) Prior Publication Data

US 2006/0138875 A1 Jun. 29, 2006

(30) Foreign Application Priority Data

Dec. 24, 2004 (KR) ..... 10-2004-0112129

(51) Int. Cl.
*H02K 33/00* (2006.01)

(52) U.S. Cl. ..... 310/15; 310/36

(58) Field of Classification Search ..... 310/15, 310/17, 20, 36, 37, 12
See application file for complete search history.

(56) References Cited

U.S. PATENT DOCUMENTS

| | | | | |
|---|---|---|---|---|
| 3,470,403 | A * | 9/1969 | Bey | 310/37 |
| 3,500,080 | A * | 3/1970 | Bey | 310/29 |
| 4,992,685 | A * | 2/1991 | Boon et al. | 310/37 |
| 5,144,176 | A * | 9/1992 | Popper | 310/81 |
| 5,602,432 | A * | 2/1997 | Mizutani | 310/15 |
| 5,994,854 | A * | 11/1999 | Lawrenson et al. | 318/114 |
| 6,262,500 | B1 * | 7/2001 | Wakiwaka et al. | 310/15 |

FOREIGN PATENT DOCUMENTS

| | | |
|---|---|---|
| JP | 6-7408 | 1/1994 |
| JP | 2000-186699 | 7/2000 |
| JP | 2000-323882 | 11/2000 |
| JP | 2004-215472 | 7/2004 |
| JP | 2005-133555 | 5/2005 |
| KR | 1989-23154 | 12/1989 |
| KR | 1993-25963 | 12/1993 |
| KR | 1996-2198 | 1/1996 |
| KR | 1997-45451 | 7/1997 |
| KR | 1997-66108 | 10/1997 |
| KR | 2001-60174 | 7/2001 |
| KR | 2003-96817 | 12/2003 |

OTHER PUBLICATIONS

PCT Search Report dated Jan. 25, 2006 issued in PCT/KR2005/3414.
Korean Office Action dated Jan. 31, 2006 issued in KR 2004-112129.

* cited by examiner

*Primary Examiner*—Dang D Le
(74) *Attorney, Agent, or Firm*—Stanzione & Kim, LLP

(57) ABSTRACT

A ventilation apparatus includes a stator, a vibrator arranged close to the stator, a permanent magnet to generate a magnet flux to form a path of the magnet flux along the stator and the vibrator, a coil wound around the stator or vibrator, and a ventilator coupled to the vibrator and operated by a linear reciprocating motion of the vibrator generated when an electric current is applied to the coil to change the magnet flux of the permanent magnet. Thus, the ventilation apparatus having a simplified ventilation structure increases a ventilation efficiency.

20 Claims, 6 Drawing Sheets

VENTILATION APPARATUS

CROSS-REFERENCE TO RELATED APPLICATIONS

This application claims the benefit of Korean Patent Application No. 2004-112129, filed on Dec. 24, 2004, in the Korean Intellectual Property Office, the disclosure of which is incorporated herein by reference.

BACKGROUND OF THE INVENTION

1. Field of the Invention

The present general inventive concept relates to a ventilation apparatus, and more particularly, to a ventilation apparatus having an improved ventilation structure, and an electronic system having the same.

2. Description of the Related Art

Generally, a ventilation apparatus is a device causing air to flow. The ventilation apparatus is classified into a rotary type ventilation apparatus, a linear type ventilation apparatus, and so on according to an operating character, and mainly used in an air conditioning system, an air induction/exhaustion system, or a cooling system.

The rotary type ventilation apparatus includes a motor, such as a domestic electric fan or a cooling fan, and the linear type ventilation apparatus includes a bellows or a fan.

Conventionally, the rotary type ventilation apparatus is inexpensive due to a well-prepared mass production system thereof. However, it has a problem in that a thermal efficiency is low relatively and a noise is high during rotating at high speed.

Also, the linear type ventilation apparatus has problems in that an energy efficiency is low, a structure is complex, and dimensions are large because it comprises a crank and a gear converting a rotary motion into a linear motion.

Recently, a ventilation apparatus using a piezoelectric element has been developed. It is an advantage that a structure thereof is small and light. However, is has a defect that an input voltage should be high, a lifetime is shortened, and production costs are increased.

SUMMARY OF THE INVENTION

The present general inventive concept provides a ventilation apparatus having a simplified ventilation structure to increase a ventilation efficiency, and an electronic system having the same.

Additional aspects and/or advantages of the present general inventive concept will be set forth in part in the description which follows and, in part, will be obvious from the description, or may be learned by practice of the present general inventive concept.

The foregoing and/or other aspects of the present general inventive concept may be achieved by providing a ventilation apparatus comprising a stator, a vibrator arranged close to the stator, a permanent magnet to generate a magnet flux to form a path of the magnet flux along the stator and the vibrator, a coil wound around one of the stator and the vibrator, and a ventilator coupled to the vibrator and operated by a linear reciprocating motion of the vibrator generated when an electric current is applied to the coil to change the magnet flux of the permanent magnet.

The ventilator comprises a first end supported by the stator.

The ventilator comprises an elastic part coupled to the vibrator and operated by the linear reciprocating motion of the vibrator, and a ventilation part connected with the elastic part in a single body to linearly reciprocate.

The ventilator is shaped like a plate.

The foregoing and/or other aspects of the present invention general inventive concept may also be achieved by providing a ventilation apparatus comprising a stator having a base and one or more extensions formed on the base, a ventilator having a first end coupled to the stator and a second end as a free end, a vibrator formed on the ventilator and disposed to move with respect to the one or more extensions of the stator, a permanent magnet disposed on the stator to generate a magnet flux along the stator and the vibrator, and a coil wound around one of the one or more extensions of the stator and the vibrator, wherein the second end of the ventilator moves when the vibrator moves with respect to the one or more extensions according to a direction of an electric current applied to the coil to change the magnet flux of the permanent magnet.

The foregoing and/or other aspects of the present invention general inventive concept may also be achieved by providing an electronic system having a ventilation apparatus to ventilate air therein, the electronic system comprising a heat-generating component, an air duct, a case to contain the heat-generating component, the air duct, and a ventilation apparatus disposed in the case to generate an airflow to control a temperature of an inside of the electronic system, the ventilation apparatus comprising a stator, a vibrator arranged adjacent to the stator, a permanent magnet to generate a magnet flux to form a path of the magnet flux along the stator and the vibrator, a coil wound around one or the stator and the vibrator, and a ventilator coupled to the vibrator and operated by a linear reciprocating motion of the vibrator generated when an electric current is applied to the coil to change the magnet flux of the permanent magnet.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
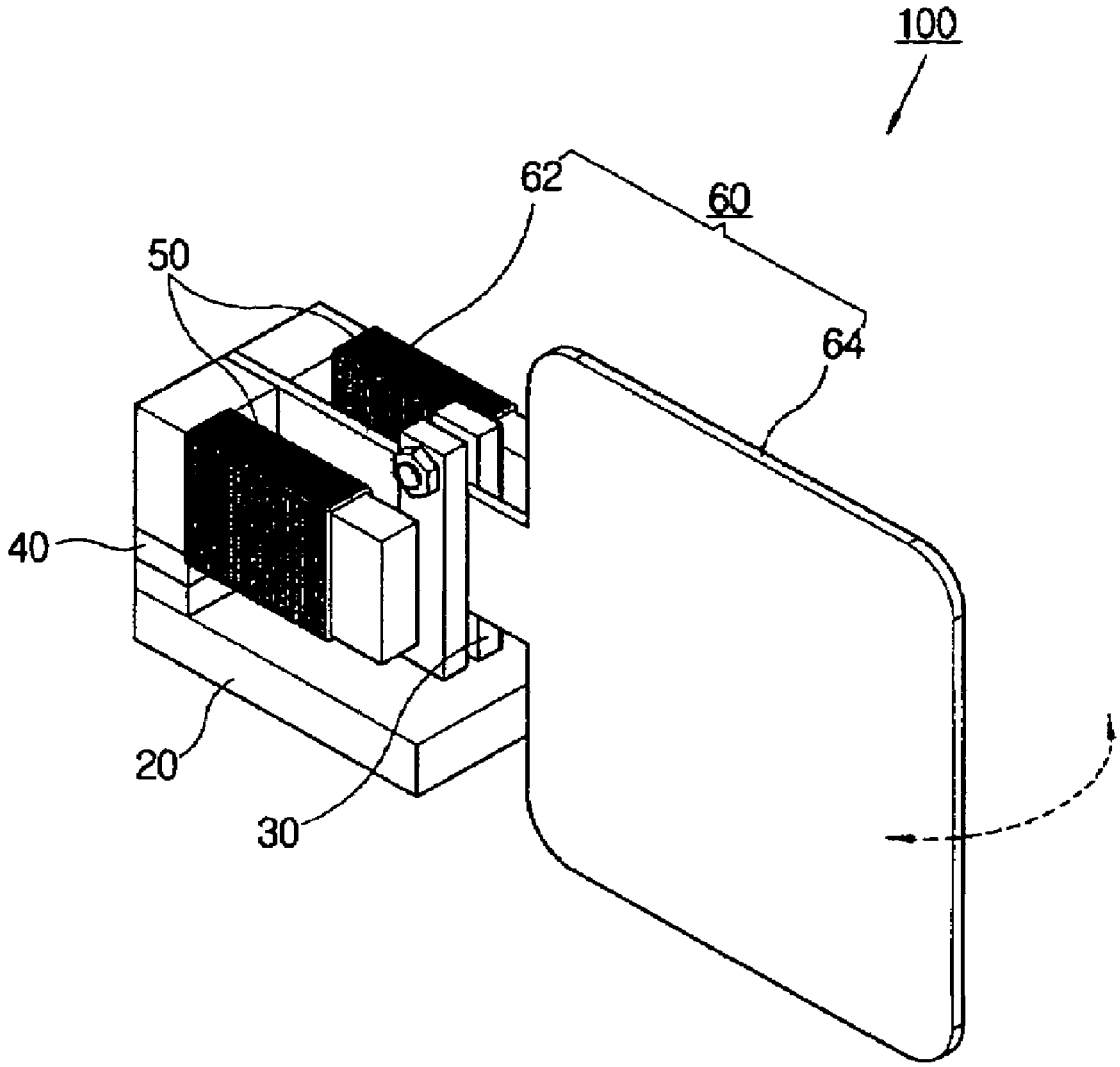
FIG. 1 is a perspective view of a ventilation apparatus according to an embodiment of the present general inventive concept.

Reference will now be made in detail to the embodiments of the present general inventive concept, examples of which are illustrated in the accompanying drawings, wherein like reference numerals refer to like elements throughout.

Figure 2:
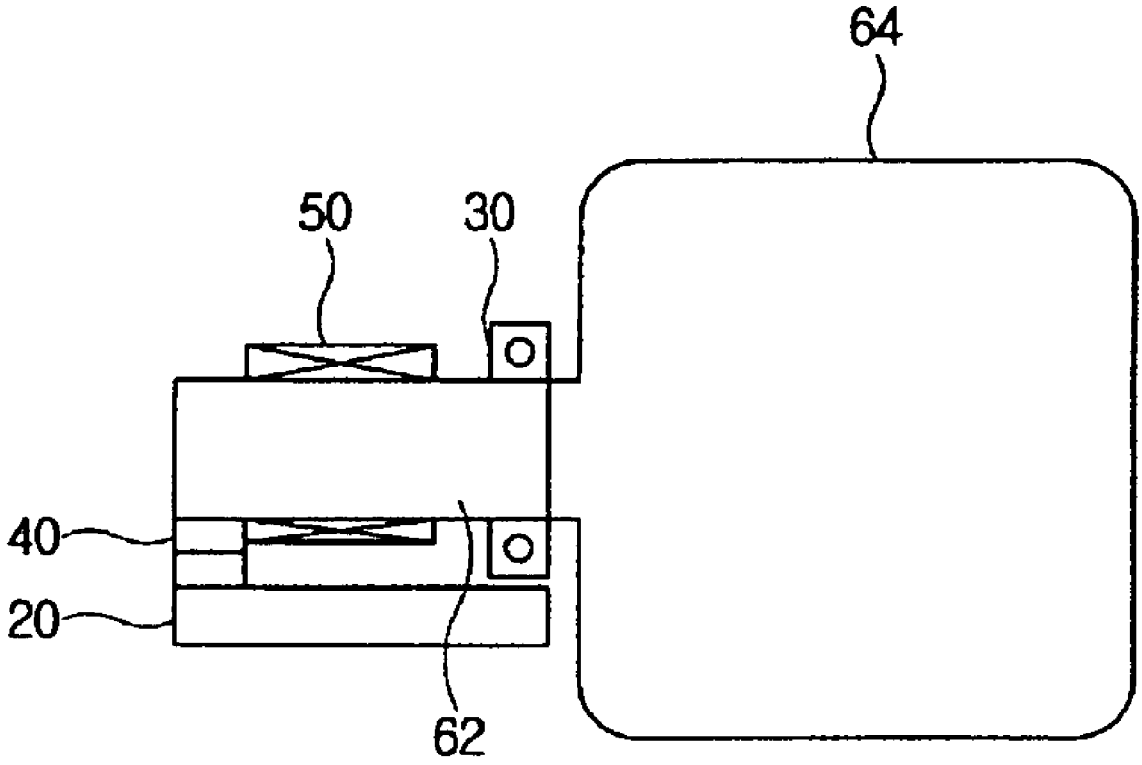
FIG. 2 is a front view of the ventilation apparatus of FIG. 1.
Figure 3:
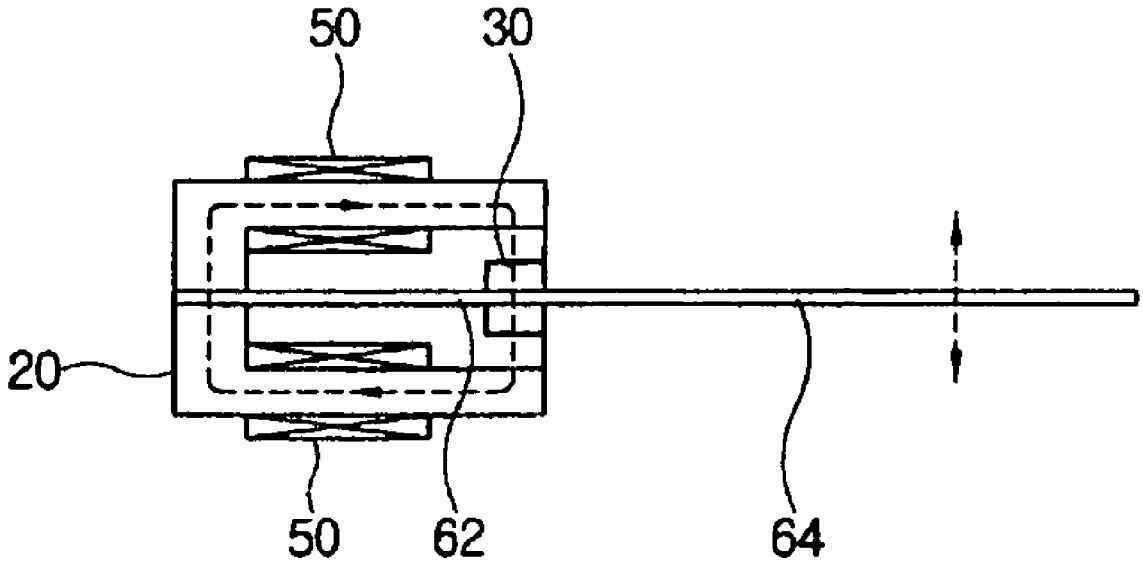
FIG. 3 is a side view of the ventilation apparatus of FIG. 1.

As shown in FIGS. 1 to 3, a ventilation apparatus 100 according to an embodiment of the present general inventive concept comprises a stator 20, a vibrator 30 arranged close to the stator 20, a permanent magnet 40 to generate a magnetic flux to form a path of the magnetic flux along the stator 20 and the vibrator 30, a coil 50 wound around the stator 20, and a ventilator 60 coupled to the vibrator 30.

When an electric current is applied to the coil 50, and the magnetic flux of the permanent magnet 40 is changed, the vibrator 30 generates a linear reciprocating motion according to the changes of the direction of the magnetic flux. The ventilator 60 is operated by the linear reciprocating motion of the vibrator 30. That is, the vibrator 30 linearly reciprocates by an interaction between the magnetic flux generated when the electric current is applied to the coil 50, and the magnetic flux by the permanent magnet 40, and then the ventilator 60 is operated as a fan to generate ventilation.

Although a first end of the ventilator 60 is supported by the stator 20, a supporting structure of the ventilator 60 is not limited thereto. In order to efficiently execute a ventilation operation, the ventilator 60 may be formed of an elastic material so that the ventilation efficiency is increased.

The ventilator 60 comprises an elastic part 62 coupled to the vibrator 30 and operated by the linear-reciprocating motion of the vibrator 30, and a ventilation part 64 connected with the elastic part 62 in a single body to linearly reciprocate. Particularly, a ventilation efficiency can be increased when a natural vibration frequency by power of the elastic part 62 and a mass of the vibrator 30 is equal to a natural vibration frequency of the ventilation part 64.

The elastic part 62 and the ventilation part 64 may have a shape of a plate. However, the shape thereof is not limited thereto.

The stator 20 and the vibrator 30 comprise a magnetic material, and a shape and arrangement structure thereof may be changed according to a method of generating the linear reciprocating motion of the vibrator 30.

The coil 50 is wound around the stator 20 so that a direction of the magnetic flux generated by the coil 50 can be parallel to a direction of the magnetic flux generated by the permanent magnet 40 according to Maxwell's force laws which may be used in a case that a large operating force is required.

Besides, a mechanism to increase the linear reciprocating motion of the vibrator 30 may be a mechanism having a pivot (not shown) between the vibrator 30 and the ventilation part 60 according to a pawl principle.

Figure 4:
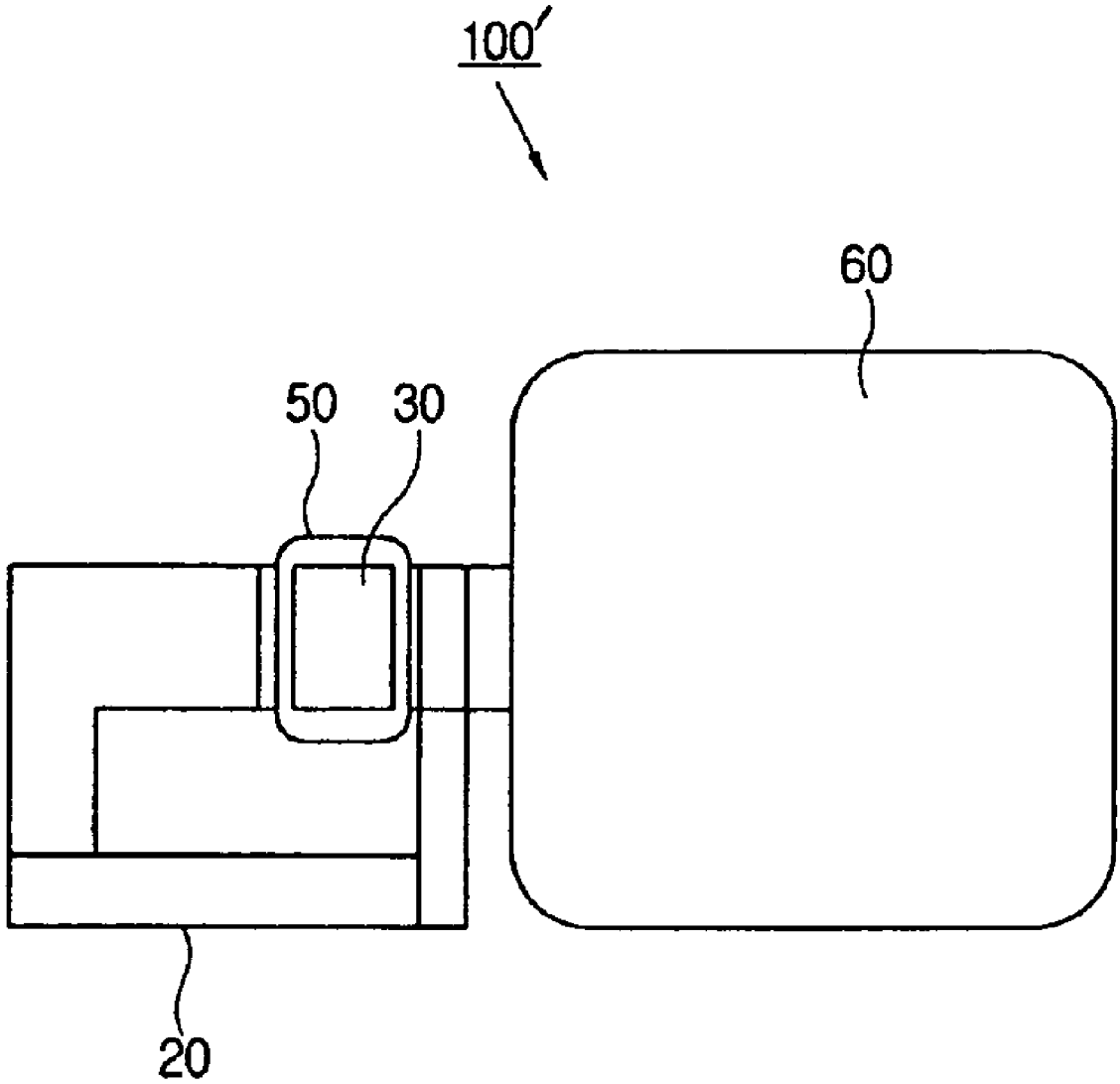
FIG. 4 is a front view of the ventilation apparatus according to an embodiment of the present general inventive concept.
Figure 5:
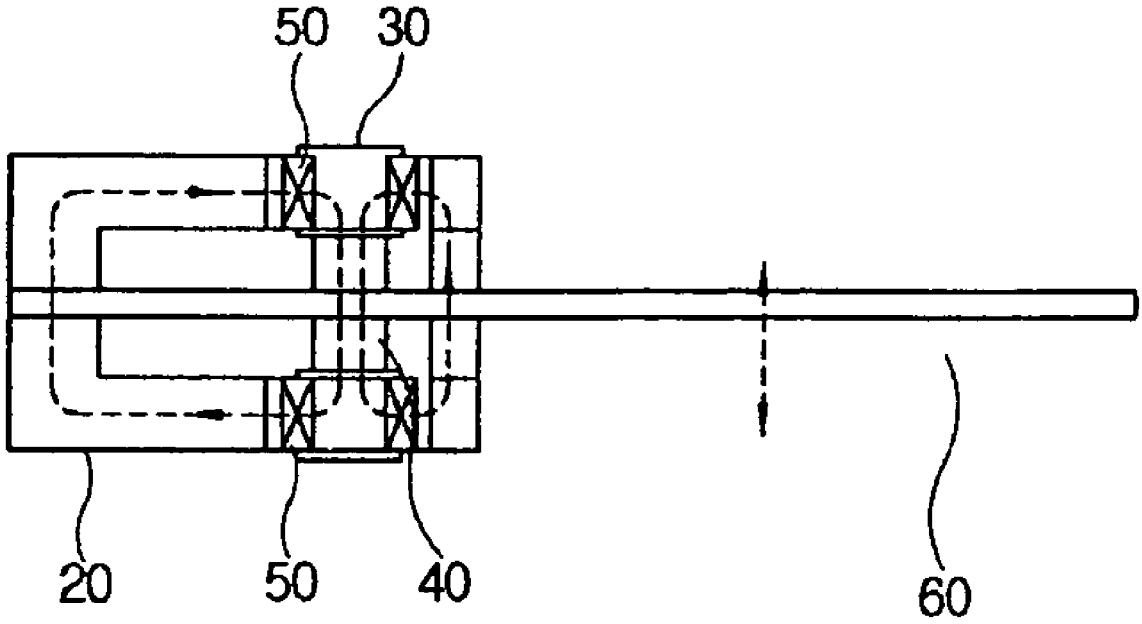
FIG. 5 is a side view of the ventilation apparatus of FIG. 4.

As shown in FIGS. 4 and 5, to generate a linear reciprocating motion of the vibrator 30 and then operate the ventilation part 60, a ventilation apparatus 100' according to an embodiment of the present general inventive concept may have such a structure that the coil 50 is wound around the vibrator 30 so that a direction of a magnetic flux generated by the coil 50 is at right angles with a direction of a magnetic flux generated by the permanent magnet 40 according to Lorentz force law which may be used mainly in a case that a relatively large amplitude is required.

The ventilation apparatus 100 or 100' according to the embodiment of the present general inventive concept performs the ventilation operation by operating the ventilation part 60 according to the linear reciprocating motion by the vibrator 30.

Figure 6:
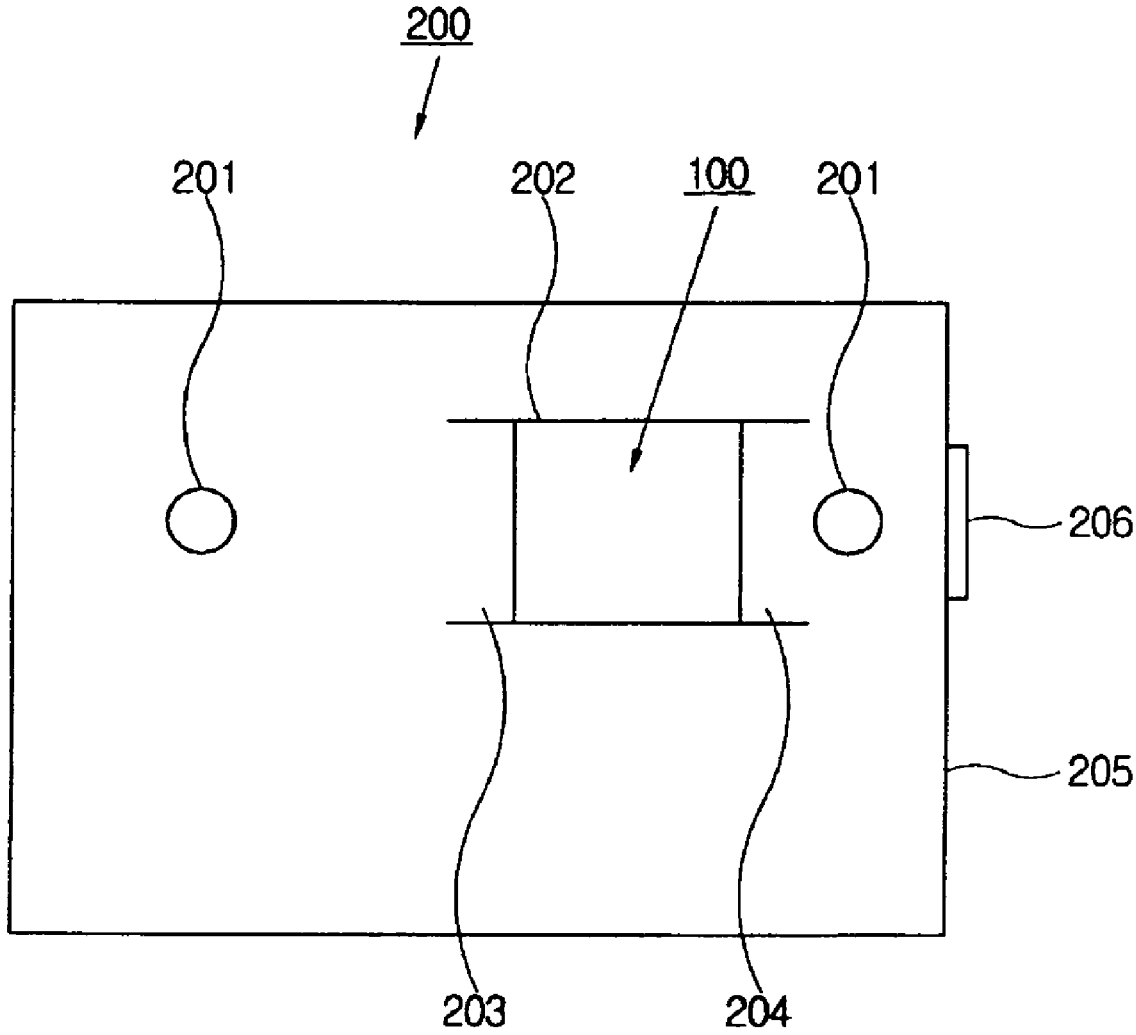
FIG. 6 is a view of an electronic system having a ventilation apparatus according to an embodiment of the present general inventive concept.

FIG. 6 is a view of an electronic system 200 according to an embodiment of the present general inventive concept. Referring to FIGS. 1, 4, and 6, the electric system 200 includes a heat-generating component 201, an air duct 202 having an inlet 203 and an outlet 204, and a case 205 to contain the heat-generating component 201, the air duct 202. The ventilation apparatus 100 or 100' may be disposed in the air duct 202 to generate an airflow to control a temperature of an inside of the electronic system 200 by discharging air contained in the electronic system 200 toward an outside of the electronic system 200. The electronic system 200 may be an electrical apparatus having a printed circuit board to operate components therein, an air conditioning system, an air induction/exhaustion system, or a cooling system. The heat-generating component 201 may be a heat exchange component or an integrated circuit and may be disposed around the inlet 203 or the outlet 204 so that the ventilation apparatus 100 or 100' can control a temperature of the heat-generating component 201 or a temperature of air contained around the heat-generating component 201. One of the inlet 203 and the outlet 204 may be an opening 206 formed on a surface of the case 205 of the electronic system 200.

As described above, the ventilation apparatus according to the embodiment of the present general inventive concept can cause air to flow in a direction so as to control a temperature of an electrical component in an electronic apparatus, for example, control the air to be discharged outside the electronic system or to be flow into the inside of the electronic system.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A ventilation apparatus comprising:

a stator;

a vibrator arranged adjacent to the stator;

a permanent magnet to generate a magnet flux to form a path of the magnet flux along the stator and the vibrator;

a coil wound around one of the stator and the vibrator; and a ventilator coupled to the vibrator and operated by a linear reciprocating motion of the vibrator generated when an electric current is applied to the coil to change the magnet flux of the permanent magnet.

2. The ventilation apparatus according to claim 1, wherein the ventilator comprises an end supported by the stator.

3. The ventilation apparatus according to claim 2, wherein the ventilator comprises:

an elastic part coupled to the vibrator and operated by the linear reciprocating motion of the vibrator; and a ventilation part connected with the elastic part in a single body to linearly reciprocate.

4. The ventilation apparatus according to claim 3, wherein the ventilator comprise a plate.

5. The ventilation apparatus according to claim 1, wherein the ventilator comprises:

an elastic part coupled to the vibrator and operated by the linear reciprocating motion of the vibrator; and a ventilation part connected with the elastic part in a single body to linearly reciprocate.

6. The ventilation apparatus according to claim 5, wherein the ventilator comprises a plate.

7. The ventilation apparatus according to claim 1, wherein the stator comprises a base and two extensions formed on the base, and the coil comprises first and second coils wound around the respective extensions of the stator.

8. The ventilation apparatus according to claim 7, wherein the vibrator is disposed between the two extensions to move between the first and second coils.

9. The ventilation apparatus according to claim 7, wherein the ventilator comprises a first end coupled to the base, a middle portion extended from the first end and coupled to the vibrator, and a second end extended from the middle portion as a free end.

10. The ventilation apparatus according to claim 9, wherein the first end, the middle portion, and the second end are formed in a monolithic single body.

11. The ventilation apparatus according to claim 1, wherein the vibrator is supported by the ventilator to be spaced apart from the stator, and the vibrator and the ventilator are formed in a monolithic single body.

12. The ventilation apparatus according to claim 1, wherein the stator comprises a base and one or more extensions formed on the base, and the coil is wound around the one or more extensions so that the vibrator moves with respect to the one or more extensions according to the electric current applied to the coil.

13. The ventilation apparatus according to claim 1, wherein the stator comprises a base and one or more extensions formed on the base, and the coil is wound around the vibrator so that the vibrator moves with respect to the one or more extensions and permanent magnet according to the current applied to the coil.

14. A ventilation apparatus comprising:

a stator having a base and one or more extensions formed on the base;

a ventilator having a first end coupled to the stator and a second end as a free end;

a vibrator formed between the first and second ends of the ventilator and disposed to move with respect to the one or more extensions of the stator;

a permanent magnet disposed on the stator to generate a magnet flux along the stator and the vibrator; and a coil wound around one of the one or more extensions of the stator and the vibrator, wherein the second end of the ventilator moves when the vibrator moves with respect to the one or more extensions according to a direction of an electric current applied to the coil to change the magnet flux of the permanent magnet.

15. The ventilation apparatus according to claim 14, wherein the first and second ends of the ventilator are formed in a direction, and the one or more extensions are extended from the base in the direction of the ventilator.

16. The ventilation apparatus according to claim 15, wherein the vibrator is disposed in a second direction having an angle with the direction.

17. The ventilation apparatus according to claim 14, wherein the one or more extensions comprise a first extension and a second extension, the coil is wound around the first and second extensions, and the vibrator is disposed to move between the first and second extensions.

18. The ventilation apparatus according to claim 14, wherein the coil is wound around the vibrator so that the vibrator moves with respect to the one or more extensions.

19. The ventilation apparatus according to claim 14, wherein the coil, the vibrator, and the permanent magnet form a path of the magnetic flux which is changed when the current is applied to the coil.

20. An electric system having a ventilation apparatus to ventilate air therein, comprising:

a heat-generating component;

an air duct;

a case to contain the heat-generating component and the air duct; and a ventilation apparatus disposed in the case to generate an airflow to control a temperature of an inside of the electronic system, the ventilation apparatus comprising:

a stator, a vibrator arranged adjacent to the stator, a permanent magnet to generate a magnet flux to form a path of the magnet flux along the stator and the vibrator, a coil wound around one of the stator and the vibrator, and a ventilator coupled to the vibrator and operated by a linear reciprocating motion of the vibrator generated when an electric current is applied to the coil to change the magnet flux of the permanent magnet.

* * * * *